US006723060B2

(12) United States Patent
Miller

(10) Patent No.: US 6,723,060 B2
(45) Date of Patent: Apr. 20, 2004

(54) VIBRATOR

(76) Inventor: Edward W. Miller, P.O. Box 535, Salem, OR (US) 97308

( * ) Notice: Subject to any disclaimer, the term of this patent is extended or adjusted under 35 U.S.C. 154(b) by 60 days.

(21) Appl. No.: 10/072,256

(22) Filed: Feb. 7, 2002

(65) Prior Publication Data

US 2003/0149381 A1 Aug. 7, 2003

(51) Int. Cl.[7] ..... A61H 7/00

(52) U.S. Cl. ..... 601/101; 601/108; 601/97; 606/238

(58) Field of Search ..... 601/6, 17, 46, 601/48, 72–74, 80, 81, 89, 93–95, 97, 101, 103, 107, 108, 110, 111, 112–114; 606/237–239; 81/463, 464

(56) References Cited

U.S. PATENT DOCUMENTS 1,882,040 A * 10/1932 Roehm ..... 601/6
3,710,875 A 1/1973 Hilger
3,955,563 A * 5/1976 Maione ..... 601/106
4,016,873 A * 4/1977 Anderson ..... 601/107
4,203,431 A * 5/1980 Abura et al. ..... 601/6
4,566,442 A * 1/1986 Mabuchi et al. ..... 601/101
4,716,890 A * 1/1988 Bichel ..... 601/108
4,827,914 A 5/1989 Kamazawa
5,300,095 A 4/1994 Salazar
6,228,042 B1 5/2001 Dungan
6,511,445 B2 * 1/2003 Sivan et al. ..... 601/6

* cited by examiner

*Primary Examiner*—Nicholas D. Lucchesi
*Assistant Examiner*—Quang D Thanh
(74) *Attorney, Agent, or Firm*—Carl D. Crowell

(57) ABSTRACT

A therapeutic vibrator comprising a motor contained in a housing, a diaphragm mounted on said housing, and a reciprocating arm connecting the motor to the diaphragm. The housing is fitted with at least one one-way air valve, and at least one air hole so that in operation, the changing volume in the housing effects the pumping of air across the motor and any circuitry to provide cooling. To improve efficiency, a divider plate with at least one air hole is disposed proximate the reciprocating arm to limit the volume of the pumping chamber.

4 Claims, 2 Drawing Sheets

VIBRATOR

BACKGROUND OF THE INVENTION

1. Field of the Invention

The present invention relates to a mechanical therapeutic apparatus. More particularly, it relates to percussive vibrators used in chiropractic care.

2. Prior Art

Percussion is a treatment modality for those who suffer from problems such as musculoskeletal pain and myofascial trigger syndrome. It is non-surgical, non invasive procedure that may serve as a therapeutic alternative to trigger point and epidural injections or to be used when other treatments have failed.

There are many known devices that facilitate treatment or change in soft and hard tissue. A common element of these devices is that they tend to be small and hand held to facilitate use. For the device to work properly it must also be powerful enough to effect the necessary force to be therapeutic. A side effect of the combination of small size and power are the problems associated with excess heat generated by instruments in use.

Excess heat leads to shortened component life, and may add to discomfort in the use of the device.

Devices in the field of the invention are by their nature under extensive amounts of mechanical stress in their normal course of use. The nature of a vibrating tool makes the addition of a fan or other additional cooling apparatus difficult. In addition the adding any new moving member to such a tool adds to the potential of component failure and noise.

The present invention is directed to this shortcoming in the prior art in that it provides for quiet cooling at low cost, without adding additional components which may be subject to failure. The invention is also a means for providing cooling in vibratory or reciprocating tools of many other fields.

BRIEF SUMMARY OF THE INVENTION

It is an object of the present invention to provide a percussive vibrator tool with quiet improved heat dissipating qualities.

The operation and benefit of the invention is to use the vibrating or reciprocating arm component to provide the percussive force of the invention and the impelling force to pump air through the device to provide cooling.

The body of the vibrator is a sealed case which serves as an air chamber. It is fitted with one or more one-way air valves. A reciprocating arm, or vibratory impeller is attached to a sealed diaphragm to permit vibration of an impact head while maintaining a largely air tight seal.

As the impact head is moved, the volume of the body of the vibrator oscillates. Air is permitted to enter at one point fitted with a one-way air valve on expansion, and expelled on retraction or contraction. The body of the vibrator essentially operates as a pump.

While multiple check valves may be used, an inexpensive and preferred option is to use a single air valve at one point, and small or air limiting restrictive openings at another. These restrictive openings may be one or more small holes that limit air flow so that on body volume expansion, air enters through the one-way air valve and the holes, but on contraction, there is a net movement of air as air moves out only through the air holes.

To effect a greater volume of net air flow and greater cooling, the volume of the air space in the vibrator should be kept as small as possible relative to the tidal volume created by the vibratory impeller. Though the entire body of the vibrator may be used as the air chamber or housing, for greater efficiency a divider plate or other divider may be used to create a smaller air chamber or housing surrounding the reciprocating components. In the preferred embodiment of the invention this is accomplished by limiting the air chamber or housing to the immediate vicinity of the reciprocating arm, with the air inlet and one way valve placed on the top of the device, and small restricted air holes placed on a divider plate, isolating the air chamber from the motor and circuitry to be cooled.

Air is pumped by the reciprocating arm through the housing and into the remainder of the body of the vibrator to cool the motor and any circuitry.

For a more complete understanding of the present invention, reference is made to the following detailed description and accompanying drawings.

BRIEF DESCRIPTION OF THE SEVERAL VIEWS OF THE DRAWING

In the drawings, like reference characters refer to like parts through the several views.

DETAILED DESCRIPTION OF THE INVENTION

Figure 1:
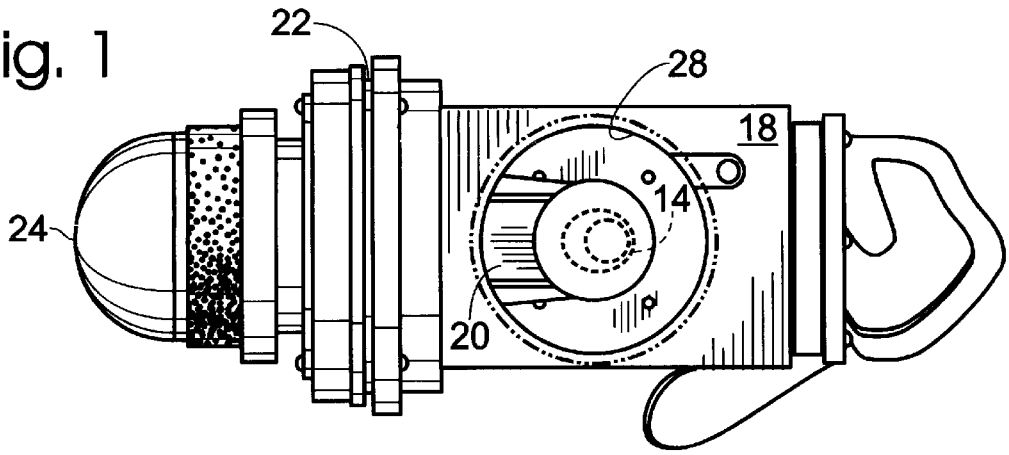
FIG. 1 is top elevation of the invention with the sealing cap removed.
Figure 2:
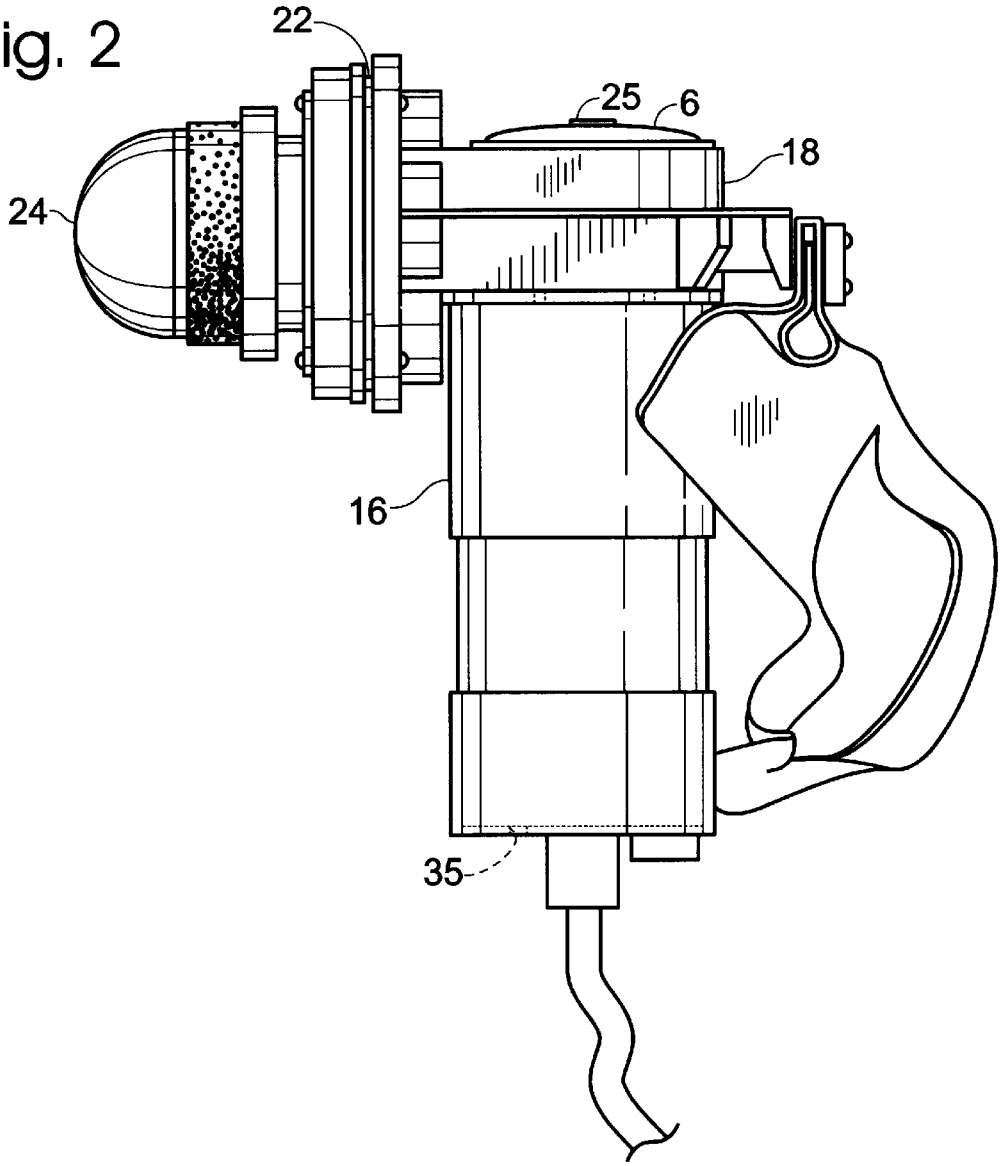
FIG. 2 is a side elevation of the invention.

In the preferred embodiment, the motor of the device 12 is enclosed in a case which is comprised of a grip 16 to allow for ease of grasping and manual manipulation on the patient's affected area, and a housing 18 as depicted in FIGS. 1 and 2.

The housing 18 is disposed at one end of the grip 16, and contains a cam 14 attached to the drive shaft 8 of the motor 12. The motor 12 which may be a d.c., a.c. or stepper motor is located principally in the grip 16. A reciprocating arm 20 is attached on a first end to the cam 14 and on a second end is connected to the backside of a sealed diaphragm 22. A removable impact head 24 is attached to the outside of the sealed diaphragm 22.

The housing 18 is open on the bottom to receive the drive shaft 8 and on the top to receive a sealing cap 6 with a one-way air valve 25. A third lateral opening is fitted with the sealed diaphragm 22.

The bottom opening 26 of the housing is fitted with a divider plate 7 penetrated by the drive shaft 8, which has at least one hole 10 to permit limited airflow. The airflow is limited to the extent that the housing 18 is able to retain some pressure for a short duration of time.

In the preferred embodiment, four holes 10 are provided of less than 1 mm diameter.

The top opening 28 of the housing 18 is fitted with a sealing cap 6 which may be easily removed for cleaning, maintenance and inspection of the reciprocating arm 20 and cam 14 area. Fitted in this sealing cap 6 is a one way air valve 25 which permits air to only enter the housing 18.

The invention as a whole comprises a motor 12 driving the drive shaft 8 which turns the cam 14. Rotatably mounted on the cam 14 is a reciprocating arm 20 which is attached to the inside portion of the sealed diaphragm 22, causing the diaphragm to vibrate. Under normal use, removably mounted on the outside of the sealing diaphragm is an impact head 24 to be placed on the area of the body needing treatment.

Figure 3:
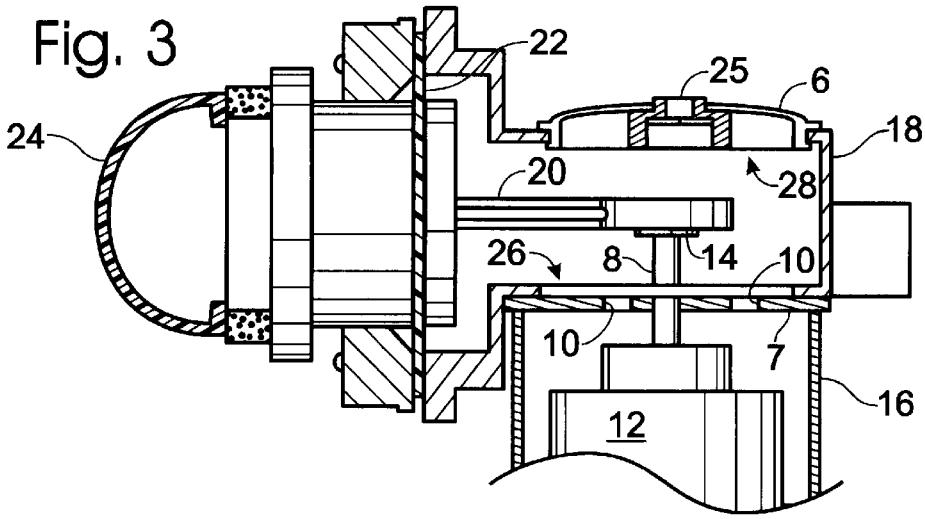
FIG. 3 is a cross sectional view of the invention in a neutral position.
Figure 4:
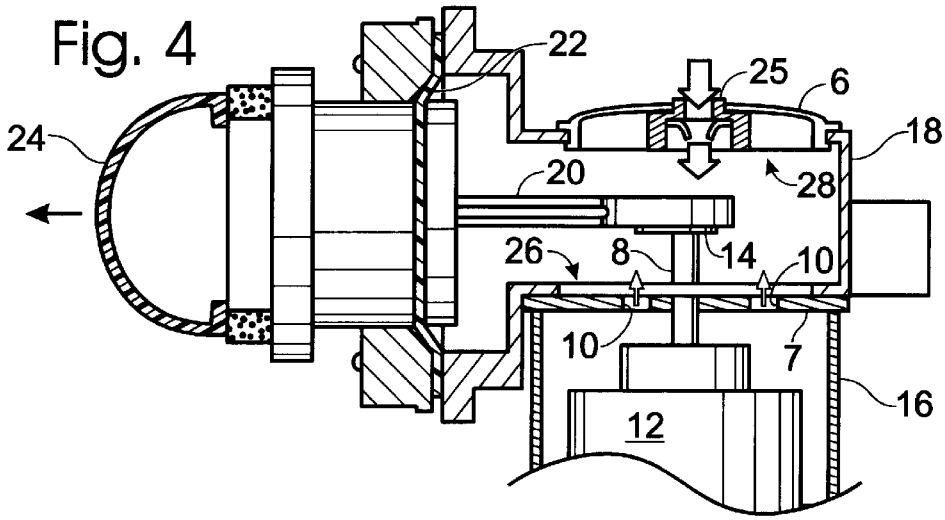
FIG. 4 is a cross sectional view of the invention with the reciprocating arm extended, depicting airflow.

The vibration of the diaphragm 22 is such that the volume of the housing 18 oscillates. As the reciprocating arm 20 extends the diaphragm 22, volume in the housing 18 increases as depicted in FIG. 4. The housing 18 experiences a drop in pressure and air enters the housing through the openings in the divider plate 7 through the air holes 10 and though the one-way air valve 25 in the access cap 6. For comparison, a cross sectional view with the reciprocating arm 20 and diagram 22 in a neutral state is depicted in FIG. 3.

Figure 5:
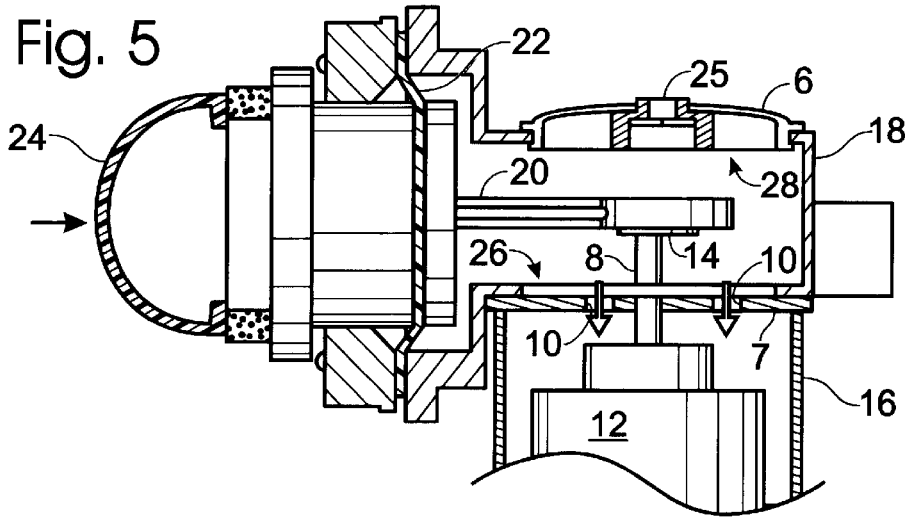
FIG. 5 is a cross sectional view of the invention with the reciprocating arm withdrawn depicting airflow.

As the reciprocating arm 20 retracts the diaphragm 22, volume in the housing 18 decreases. The housing 18 experiences high pressure and air is forced out of the air holes 10 provided in the divider plate 7 only as depicted in FIG. 5.

The result of the configuration of air holes 10 and at least one, one-way valve 25 is that there is a net transit of air that is pumped through the housing 18. This air is then pumped into the grip 16 which has a small exit port 35 opposite the divider plate 7 allowing the pumped air to transit the motor 12 and any circuitry (not shown) to provide cooling.

While the invention has been illustrated and described in detail in the drawings and the foregoing description, the same is to be considered as illustrative and not restrictive in character, it being understood that only the preferred embodiment has been shown and described fully and that all changes and modifications that come within the spirit of the invention are desired to be protected.

I claim:

1. A therapeutic vibrator tool comprising:

a motor contained in a case, said case comprised of a grip portion and a housing portion, a diaphragm mounted on said housing portion, a reciprocating arm with a first end and a second end, said first end attached to said motor, said second end attached to said diaphragm, an impact head mounted on said reciprocating arm external to said housing portion, said case fitted with an at least one one-way air valve, and an at least one air exit port, said at least one one-way air valve and said at least one air exit port being disposed to permit a net transit of air to be pumped through said housing portion.

2. The vibrator of claim 1, further comprising:

a divider plate disposed proximate said reciprocating arm, disposed in said divider plate an at least one air hole.

3. A therapeutic vibrator tool comprising:

a case comprised of a grip and a housing, said grip having an exit port, said housing having a top, bottom and four sides, said housing bottom being conjoined with said grip, disposed within said case is a motor with a drive shaft, a cam is affixed to said drive shaft, a reciprocating arm is affixed to said cam, disposed in said housing top is an opening removably fitted with a sealing cap, said sealing cap containing a one-way air valve disposed on one side of said housing is an opening fitted with a diaphragm, said diaphragm having an inside and an outside, said reciprocating arm is affixed to the inside of said diaphragm, affixed to the outside of said diaphragm is an impact head.

4. The vibrator tool of claim 3 further comprising:

a divider plate disposed at the conjunction of said housing and said grip, said divider plate containing an at least one hole.

* * * * *